US006434898B1

(12) United States Patent
Ward et al.

(10) Patent No.: US 6,434,898 B1
(45) Date of Patent: Aug. 20, 2002

(54) FLUSH GLAZED DOOR

(75) Inventors: Martin G. Ward, Winnipeg; Neil E. Fraser, Calgary; Stewart McEachern, Kelowna; Markus Hindemith, Calgary, all of (CA)

(73) Assignee: Masonite International Corporation, Mississauga (CA)

( * ) Notice: Subject to any disclaimer, the term of this patent is extended or adjusted under 35 U.S.C. 154(b) by 0 days.

(21) Appl. No.: 09/186,229

(22) Filed: Nov. 4, 1998

(51) Int. Cl.[7] ..... E06B 3/36

(52) U.S. Cl. ..... 52/204.62; 52/204.69; 52/455; 52/204.7; 52/309.9; 52/309.14

(58) Field of Search ..... 52/204.53, 204.62, 52/204.69, 204.7, 208, 309.9, 309.11, 309.14, 455, 745.15

(56) References Cited

U.S. PATENT DOCUMENTS 2,905,983 A * 9/1959 Ritz ..... 52/204.7 X
4,327,535 A * 5/1982 Governale ..... 52/309.11
4,546,585 A * 10/1985 Governale ..... 52/309.11
4,897,975 A 2/1990 Artwick et al.
5,577,355 A * 11/1996 Leonelli ..... 52/204.62
5,887,398 A * 3/1999 Chen ..... 52/309.9

* cited by examiner

*Primary Examiner*—Carl D. Friedman
*Assistant Examiner*—Jennifer I. Thissell
(74) *Attorney, Agent, or Firm*—Renner, Kenner, Greive, Bobak, Taylor & Weber

(57) ABSTRACT

The invention is directed to an insulated door and a method for manufacturing such have a glazing or window section installed therein. The frame of the window section is installed during manufacture and is flush with both faces of the door. The flush glazed door comprises a rigid wooden frame having an opening for mounting an insulated window therein, a metal sheathing secured on each side of the frame, a window frame unit mounted within the wooden frame within the opening and an insulated window positioned within the window frame unit. The window is retained within the frame in air-tight and weatherproof manner.

7 Claims, 2 Drawing Sheets

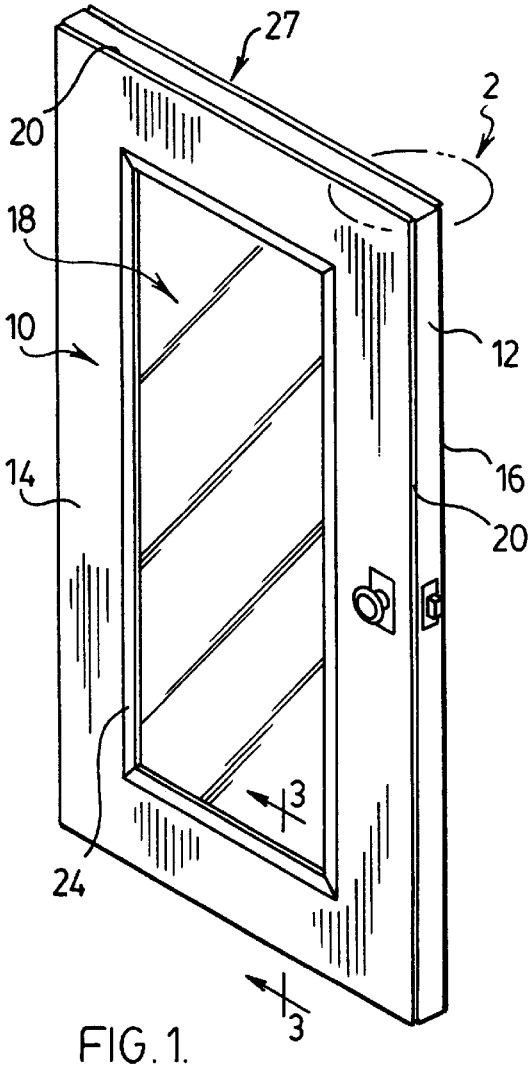
FIG. 1.
FIG. 2.
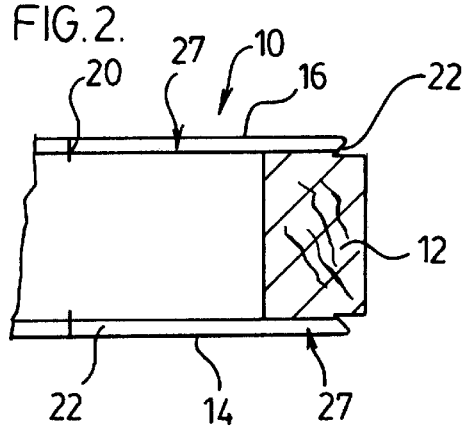
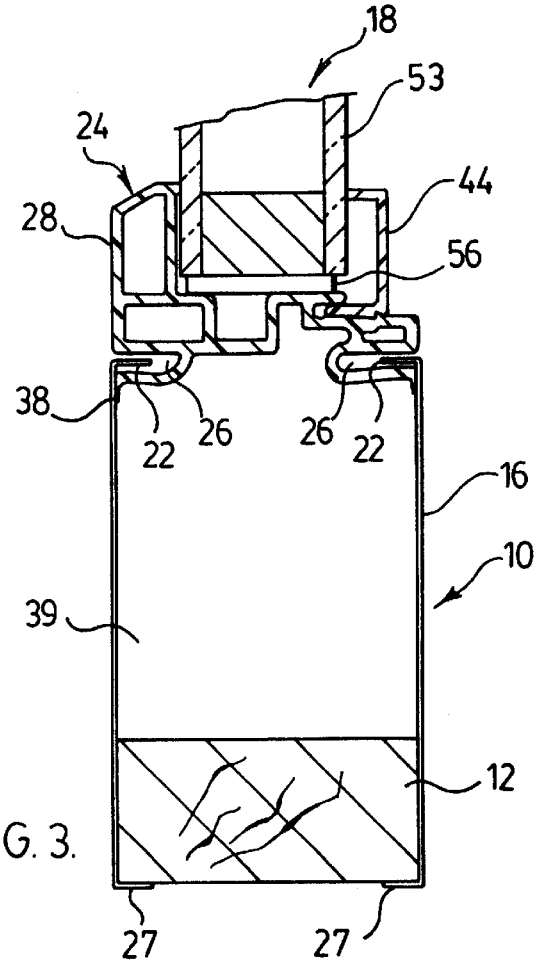
FIG. 3.

FLUSH GLAZED DOOR

FIELD OF THE INVENTION

This invention relates to the field of door manufacture and more particularly to the manufacturing of an insulated door having a glazing or window section installed therein, where the frame of said window section is installed during manufacture and is flush with both faces of the door.

BACKGROUND OF THE INVENTION

The manufacture of decorative insulated doors for residential use is a process that marries a coloured and decorative skin or sheathing to both sides of a perimeter frame. The frame usually constructed from wood, has specially formed recesses into which the longitudinal edges of the decorative sheathing can be inserted after they have been in turn correspondingly bent to fit said recesses. Frictional engagement between the frame and sheathing components secure this assembly and lend rigidity to the door structure. This door and frame unit is typically insulated with an expanding insulating foam material which is applied through very small holes drilled through the wooden frame to provide access to the internal void.

As the insulating foam expands to fill the internal door cavity, it is likely to flow outwardly through any minute perimeter imperfections between sheathing and frame resulting in time consuming cleanup by production personnel.

As a result of the foregoing, frames for glazing or window units have not generally been installed at the time of manufacture. It is common that a portion of an insulated door is cut out after manufacture to accommodate pre-made glazing units available in a variety of shapes and sizes. Said units comprise a frame, having an outer portion which is slipped into the cut out portion from the outside and which bears against the outer face of the door. An inner portion is installed in opposed facing relation so as to bear against the inner face of the door. The inner and outer two portions are connected by screws passing from the inside portion to the outer. The two parts when assembled retain a separate thermally insulated glass window unit.

This process is typically not cost effective since the part cut out from the door, once removed, have no further use and are scrapped. The insulating value of the door is obviously compromised since any retro-fitted frame will be subject to thermal transmission. Further, the window frame must be located on the outside faces of the door surrounding the window opening which can be susceptible to moisture infiltration. The door face loses the smooth linear expression by being interrupted by a bulky frame. U.S. Pat. No. 4,897,975 discloses a door light which includes a frame incorporated structurally into the door and a glass removable from the frame. Glazing stops are provided to secure within the frame to allow for the insertion and removal of glass panels. While this patent does provide an integral door light frame, it may not adequately provide a weather-proof scal about the glass panel, nor does it provide an adequately insulated door where the insulation is continuous with the glass support portion of the door. There was therefore a need to develop a simple and efficient method for making an insulated door which is rigid and strong and can accommodate a suitable glass window that has a weather-proof seal. As will be evident, the present invention obviates the problems associated with the prior art methods.

SUMMARY OF THE INVENTION

In accordance with the present invention there is provided a method and apparatus for manufacturing a door, wherein the door has a rigid wooden frame having interior and exterior faces, metal sheathing secured to the rigid wooden frame by means of preformed grooves or recesses therein which securely accept suitably formed edge portions of the sheathing, a window frame, which may be of a suitable extruded plastic, the window frame for placing within a window opening defined by the wooden frame and sheathing, that is, formed by interior and exterior sheathing assembled onto the wooden frame, the window frame for accepting for mounting therein a thermally insulated window.

The window frame has integral, outwardly facing recesses to accept suitably formed edges of the interior and exterior sheathing, such as edges bent at right angles to the sheathing.

A resilient insulation seal is integrally formed at, or mounted to, the extremity of each of the outwardly facing recesses such as along the distal edge of the recess. The seal engages the inner faces of the door sheathing thereby preventing expanding foam insulation from escaping around the perimeter of the window frame. The insulation seals may be components which are separate from the window frame and are installed around the inner and outer perimeter of the window frame during assembly. An integrally formed shoulder is formed around an exterior perimeter, parallel to the length of each window frame member, to retain a double glazed window therein. The shoulder has a longitudinal internal void or thermal break. The interior perimeter of the window frame has formed therearound a slot or channel. A shoulder, notch or step is formed along at least one sidewall of the channel for mating engagement with a corresponding shoulder, notch or step in a mating resilient clip. The clip may be a channel member having opposed side walls, where a first side wall is mated into the slot or channel in the window frame to interlock the corresponding notches on the frame and clip. The second side wall is thereby pressed against the face of the double glazed window pane retained within the window frame.

Advantageously, the second side wall may be formed of a length to allow double glazed window units of different thickness to be accommodated within window frames having the same dimensions. In order that the clip functions as a spring clip to urge the second side wall against the window pane, the first side wall and the web extending between the first and second side walls may be formed at a slightly acute included angle therebetween.

According to an object of the present invention there is provided a flush glazed door comprising;

- a rigid wooden frame having an opening for mounting an insulated window therein;
- a metal sheathing secured on each side of said frame;
- a window frame unit mounted within said wooden frame within said opening;
- an insulated window positioned within said window frame unit; and
- means for retaining said window within said frame in an air-tight and weatherproof manner.

The rigid wooden frame has a hollow internal cavity for the introduction of insulating foam therein such that when the window frame unit is mounted within said opening it is partially embedded within the introduced insulating foam as it cures.

According to another aspect of the present invention is a method for assembling a flush glazed door, said method comprising the steps of:

- constructing a rigid wooden perimeter frame having an internal cavity therein;

fitting an exterior and interior metal sheathing to said frame;

securing a window frame within said perimeter frame;

filling said interior cavity with expanding foam insulation such that said window frame is partially embedded within said perimeter frame; and mounting a window within said window frame.

The present invention provides a flush glazed door that is durable and thermally insulating and which allows one to manufacture the door without the glass insert therein such that no damage will occur to the glass as it can be easily installed at a job site. The door can accommodate varying sizes and thickness of glass and by virtue of the design of the window frame, a window can be installed therein and tightly secured in an airtight and weatherproof manner.

BRIEF DESCRIPTION OF THE DRAWINGS

A detailed description of the preferred embodiments are provided herein below with reference to the following drawings in which:

FIG. 1 is a perspective view of one embodiment of the flush glazed door of the present invention;

FIG. 2 is an enlarged view of one corner identified as "2" of the door assembly;

FIG. 3 is an enlarged sectional view along line 3—3 in FIG. 1;

Figure 4:
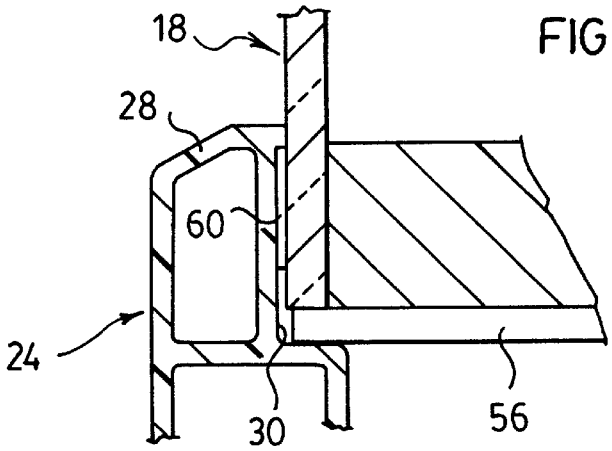
FIG. 4 is an enlarged view of the exterior shoulder potion of a window frame member of the present invention.

In the drawings, preferred embodiments of the invention are illustrated by way of example. It is to be expressly understood that the description and drawings are only for the purpose of illustration and as an aid to understanding and are not intended as a definition of the limits of the invention.

DETAILED DESCRIPTION OF THE PREFERRED EMBODIMENT

As seen in FIGS. 1–3, door 10 comprises perimeter frame members 12, exterior and interior faces 14 and 16 and a window unit 18. Frame 12 has preformed vertical grooves 20 formed in both the exterior and interior faces to accept and securely retain suitably formed edge portions 22 of the sheathing. An extruded plastic window frame 24 is positioned within door frame 12 and sheathing panels are trimmed to a size that will permit their preformed edges 22 to engage both the recesses in the perimeter frame 12 and corresponding recesses 26 formed around the exterior and interior perimeter of the window frame 24. It is preferred that each sheathing panel be made of a single piece of suitable steel that is punched and flanged to add rigidity and strength to the door. While the sheathing is fixed via grooves it is preferred that the sheath be bent at 90° angles to form lips 27 over the top and bottom edges of the door at either sides as desired.

It is understood by one skilled in the art, that the extruded plastic frame can be made of any suitable material. Such materials may include but are not restricted to plastic resin such as polyvinyl chloride of a suitable weatherability characteristic and of any suitable colour.

As can be seen in FIGS. 3–7, the extruded plastic window frame 24 has an integrally formed shoulder 28 formed around its exterior perimeter which restrains window 18 against outward movement. Shoulder 28 has a continuous cavity along its length to provide a thermal break. The interior face 30 of shoulder 28 is formed at right angles to the window surround 32, as can be seen by angle A in FIG. 5. Shoulder 28 terminates at its upper end in an inwardly projecting lip 34. Lip 34 contacts the glass pane of window unit 18 to provide a watertight seal when window unit 18 is inserted into the frame. Flanges 36 are integrally formed with window frame 24 to define recesses 26 for securely retaining therein suitably formed edge portions 22 of the door sheathing.

Flexible insulation seals 38 are formed along the free edge of flanges 36. Seals 38 press tightly against the inner faces of the door sheathing when installed in recesses 26 to prevent escape of expanding foam insulation 39 injected into the door frame cavity around the perimeter of the window frame. Seals 38 may be of a suitably flexible resilient material which may be attached to, or formed as part of, flanges 36 so as to be cantilevered outwardly of the edges of flanges 36. After the door unit is fully assembled the internal cavity is completely filled with expanding foam insulation 39.

Figure 5:
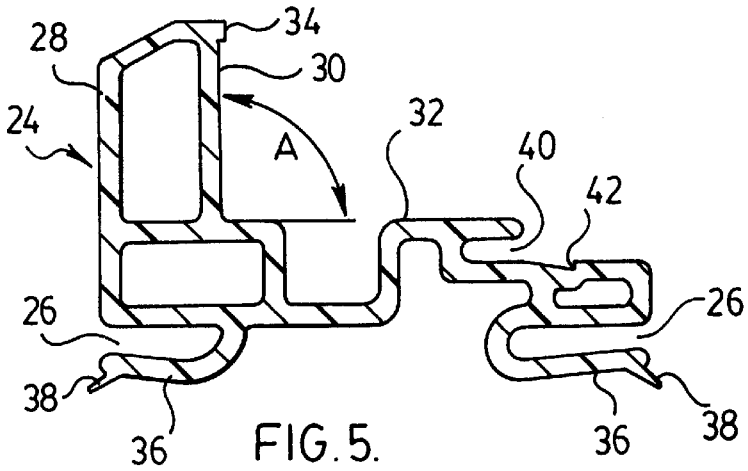
FIG. 5 is an enlarged view cross-sectional through a window frame member.
Figure 6:
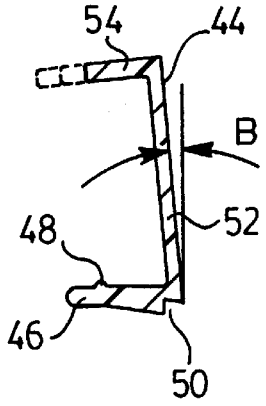
FIG. 6 is a cross-sectional view of a retainer clip.
Figure 7:
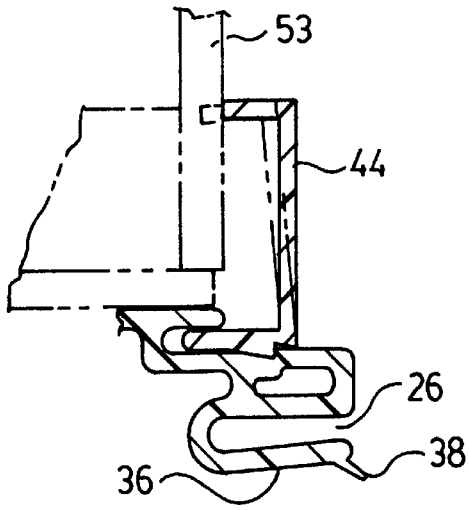
FIG. 7 is a view of the retainer clip installed against a window pane.

As seen in FIG. 5, the inner edge of window frame 24 has channel 40, parallel to surround 32, and opening toward the inside face 16 of the door. One or both side walls of channel 40 may be notched to form shoulder 42, although in FIG. 5 only the radially outer side wall (radially outer relative to the center of the window and lying in the plane of the window) is notched. Resilient retaining clip or strip 44, illustrated in FIG. 6, resiliently snaps into place to mate step 50 with shoulder 42 as side wall 46 is slid into channel 40. The clip can be fabricated in any suitable resilient and durable material such as plastic. The clip is cut to a length to suit the window frame dimensions. Side wall 46 may also have a raised projection 48 on its inside surface, opposite to step 50. Web 52 extends from the side wall 46 and is formed so as to be canted slightly toward the window when installed as indicated by angle B, that is, side wall 46 and web 52 form a slightly acute angle between them. Web 52 extends from side wall 46 to side wall 54, which also projects toward the window when clip 44 is installed. Resilient retaining clip 44 may be manufactured so as to provide clips having side walls 54 of different lengths so as to accommodate double glazed window units of different thickness, that is, having different dimensions. As will be noted from FIG. 7, the retaining clip 44 cannot be completely seated within channel 40 so as to bring step 50 and shoulder 42 into locking engagement until side wall 54 engages the inner pane of glass 53 causing web 52 to be resiliently forced into a generally perpendicular orientation relative to side wall 46. Clip 44 thus acts as a spring clip in frictional engagement with glass 53, that is, with the inside face of the window unit. The glass for use in the present invention is preferably a thermally insulated glass.

The double glazed window is generally manufactured with dimensions which are slightly undersize to that of the window frame. It is also understood that the window can be manufactured of varying widths and still be mounted within the window frame. Setting blocks 56 enable the window to be easily centred between the upper and lower portions of the frame.

Construction of an insulated door using the previously described process requires only that a rigid wooden perimeter frame be constructed, a window frame be positioned within said frame, exterior and interior sheathing strips be fitted thereto and the internal cavity be filled with expanding foam insulation. This method and the construction of the insulated door does not allow the expanding insulating foam to flow outwardly from the cavity. Thus the door of the present invention does not require any additional cleanup of any perimeters. The double glazed window need not be installed within the frame until the door is ready to be hung, thereby reducing damage or breakage during shipping. The method of manufacturing the door of the present invention does not compromise the insulating value of the finished door in any manner.

Installation of the window within the frame simply requires that double-sided glazing tape 60 as seen in FIG. 4, similar to CASCADE 2021™ (glazing tape) for example, be applied to the inside perimeter of shoulder 28. and the protective covering strip removed. Setting blocks 56 are then placed in the bottom portion of the window frame and the bottom of the double glazed window is positioned on the blocks and the unit centred within the opening. The window is then pressed firmly against the glazing tape. Lengths of retaining clip 44 are then cut to suit the frame dimensions, side wall 46 is inserted into channel 40 formed in the frame and step 50 snapped into position behind shoulder 42.

It is understood by those skilled in the art that the door of the present invention can be fabricated in various dimensions to accommodate various sized window units therein. The door has excellent insulating valve and is not susceptible to moisture infiltration about the window.

As will be apparent to those skilled in the art in the light of the foregoing disclosure, many alterations and modifications are possible in the practice of this invention without departing from the spirit or scope thereof.

What is claimed is:

1. A flush glazed door comprising:

a rigid wooden frame having an opening for mounting an insulated window therein and having an internal cavity containing insulating foam therein;

a metal sheathing secured on each side of said wooden frame;

a window frame unit mounted within said opening of said wooden frame, a bottom portion of said window frame unit being partially embedded within said insulating foam;

an insulated glass window positioned within said window frame unit;

means for retaining said glass window within said window frame unit in an air-tight and weatherproof manner;

wherein said insulating foam is continuous with said bottom portion of said window frame unit to provide adequate insulation; and wherein said window frame unit comprises an integrally formed first shoulder having a continuous cavity along its length to provide a thermal break, said first shoulder having an interior face formed at right angles to a window surround and which terminates at an upper end in an inwardly projecting lip, said lip contacting said glass to provide a watertight seal when said window is inserted into the wooden frame, and flanges integrally formed with said window frame unit to define recesses for retaining edge portions of the door sheathing, said window frame having flexible insulation seals formed along free edges of said flanges.

2. The door of claim 1, wherein said retaining means comprises a sized retainer clip which snaps into said window frame unit to frictionally engage with said glass window and retain said glass window within said opening.

3. The door of claim 1, wherein said wooden door frame has preformed vertical grooves formed in both sides of said wooden door frame and said metal sheathing has preformed edges to engage in the corresponding grooves.

4. A The door of claim 1, wherein said metal sheathing has lips which hook over the top and/or bottom of said wooden door frame.

5. The door of claim 1, wherein said window frame has an inner edge with a channel opening toward an inside face of said door, at least one of said side walls of said channel being notched to form a second shoulder.

6. The door of claim 5, wherein said retaining means comprises a retaining clip which resiliently snaps into said second shoulder.

7. A flush glazed door comprising:

a rigid wooden frame having an opening for mounting an insulated window therein;

a metal sheathing secured on each side of said wooden frame;

a window frame unit mounted within said opening of said wooden frame said window frame unit comprising a integrally formed shoulder having a continuous cavity along its length to provide a thermal break, said shoulder having an interior face formed at right angles to a window surround and which terminates at an upper end in an inwardly projecting lip, said lip contacting said insulated window to provide a watertight seal when said window frame unit is inserted into the wooden frame, and flanges integrally formed with said window frame unit to define recesses for retaining edge portions of the door sheathing, said flanges having free edges and flexible insulation seals formed along said free edges;

an insulated glass window positioned within said window frame unit; and means for retaining said glass window within said window frame unit in an air-tight and weatherproof manner.

* * * * *